US009995028B2

(12) United States Patent
Sarigöl et al.

(10) Patent No.: US 9,995,028 B2
(45) Date of Patent: Jun. 12, 2018

(54) TOILET BOWL WASHING SYSTEM

(71) Applicant: ECZACIBASI YAPI GERECLERI SANAYI VE TICARET ANONIM SIRKETI, Istanbul (TR)

(72) Inventors: Süleyman Vedat Sarigöl, Bilecik (TR); Hatice Türköz, Bilecik (TR); Nihat Baltaci, Bilecik (TR); Recep Hocaoglu, Bilecik (TR); Sefa Manav, Bilecik (TR)

(73) Assignee: ECZACIBASI YAPI GERECLERI SANAYI VE TICARET ANONIM SIRKETI, Istanbul (TR)

( * ) Notice: Subject to any disclaimer, the term of this patent is extended or adjusted under 35 U.S.C. 154(b) by 253 days.

(21) Appl. No.: 14/762,117

(22) PCT Filed: Sep. 20, 2013

(86) PCT No.: PCT/TR2013/000296
§ 371 (c)(1),
(2) Date: Jul. 20, 2015

(87) PCT Pub. No.: WO2014/123494
PCT Pub. Date: Aug. 14, 2014

(65) Prior Publication Data

US 2015/0354191 A1 Dec. 10, 2015

(30) Foreign Application Priority Data

Feb. 5, 2013 (TR) ..... 2013/01396

(51) Int. Cl.
*E03D 9/02* (2006.01)
*E03D 11/00* (2006.01)
(Continued)

(52) U.S. Cl.
CPC ..... *E03D 9/08* (2013.01); *E03D 11/13* (2013.01); *E03D 2201/40* (2013.01)

(58) Field of Classification Search
CPC ..... E03D 11/13; E03D 9/08
(Continued)

(56) References Cited

U.S. PATENT DOCUMENTS 5,715,544 A 2/1998 Huffman et al.
2012/0110826 A1* 5/2012 Reiman ..... E03C 1/0402 29/525.11

FOREIGN PATENT DOCUMENTS

DE 102006031893 A1 1/2008
EP 0519885 A1 12/1992
WO 2006136215 A2 12/2006

* cited by examiner

*Primary Examiner* — Christine Skubinna
(74) *Attorney, Agent, or Firm* — Egbert Law Offices, PLLC

(57) ABSTRACT

A washing system includes a bidet pipe system, an angled gasket used in the bidet pipe system, a cover used in the washing system with bidet pipe, which is compatible with a sanitaryware product, a cover used in the washing system without bidet pipe, which is compatible with the sanitaryware product, a washing system inner body, a washing system outer body part, a sealing element, a screw for fixing the outer body of the system to the sanitaryware product, a part for fixing the outer body of the system to the sanitaryware product, an element providing sealing between the sanitaryware product and the outer body, and a part for connecting the bidet system to the clean water pipe.

9 Claims, 8 Drawing Sheets

(51) Int. Cl.
*A61H 35/00* (2006.01)
*E03D 9/08* (2006.01)
*E03D 11/13* (2006.01)

(58) Field of Classification Search
USPC ..... 4/223, 443, 420
See application file for complete search history.

TOILET BOWL WASHING SYSTEM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a washing system which is to be installed on the clean water inlet channel coming from the reservoir on the sanitary ware product and which makes the toilet/closet bowl be washed and to a method for using the said system in order to wash the toilet bowl.

2. Description of Related Art Including Information Disclosed Under 37 CFR 1.97 and 37 CFR 1.98.

In the case that the toilets in the common places such as school, offices where we spend most of our time are not cleaned sufficiently, serious hygiene problems come about. In some of the sanitaryware products that are currently being used, there is not an additional washing system, and most of the toilets that are being used are ringed toilets which have a part called toilet ring. In the ringed toilets, the toilet bowl can be washed by means of the holes of different sizes and diameters that are available on the inner toilet bowl or on the rim (FIG. 1). However, when the washing process takes place through these holes available on the toilet bowl, the cleaning process causes a negative situation emerges in time in terms of hygiene.

Some of the toilets developed within the present state of the art are the washing systems applied on the toilets which do not comprise a ring, which is also called as rimless.

The document numbered WO2009030904A1 relates to a washing system which can be used in toilets without any ring. The said system is not an add-on system, but available on the toilet. Water flows into the bowl through the side channels (5 and 6) and the middle channel (14). This system is suitable to be used in toilets without rings, and the toilets need to have the water distribution part for distributing the water. The system mentioned in the said document is not an add-on system mounted to the toilet, but a system which has been composed on the toilet.

In the document numbered U.S. Pat. No. 6,145,138A, a washing system is disclosed, where a water passing channel has been created on the inner rim and the water is enabled to pass from this part to the bowl.

In the document numbered U.S. Pat. No. 7,661,153B2, a washing system is disclosed wherein many different embodiments are mentioned. In the system, the water enters into the side parts by means of the holes created on the side part of the toilet bowl, and progresses on through the channels opened there, and is poured into the toilet bowl from the water outlet points that there channels direct. One of the water outlet channels is located so as to move the water forward, while the other water outlet channel is located in a way to move the water in the backward direction, and therefore the water is provided to swirl. In the system, an embodiment for spraying the water with a spray rim is disclosed.

In the document numbered US2011/0023224A1, a washing system is disclosed, wherein the ⅓ of the water is flowing into the bowl from one flow path, while the remaining ⅔ is flowing from the other flow path.

In the document numbered U.S. Pat. No. 5,283,913A, the water flow is provided through the holes created in certain diameters on the rim. The rim has been constructed and arranged to allow passage of cleaning liquid into the bowl through a first hole and a second hole. The rim has a well with a well floor formed in the rim floor adjacent the front of the bowl. In one aspect, the second hole may have a larger radii than the first hole so as to pass a more powerful stream of water into the bowl. In another aspect, a plurality of first holes may be provided in the rim floor, a plurality of second holes may be provided in the well floor and a blocking member may be positioned within the well adjacent the front of the rim and equally dividing the second plurality of holes.

In the document numbered U.S. Pat. No. 5,918,325A, a system is disclosed, wherein the water passes on the rim and flows into the bowl through the holes that have been created on the rim. The holes that are located on the front part of the rim are designed larger in terms of diameter.

In the document numbered U.S. Pat. No. 5,715,544, a system is disclosed wherein toilet washing process is conducted by means of a one-piece nozzle. As the nozzle has a one-piece structure which cannot be demounted, the necessary cleaning cannot be provided. Additionally, the nozzle mentioned in the said document is not suitable for use in the toilets having a bidet system. The gap from the water outlet channels on the nozzle is not eligible to grant the water with a function.

In the document numbered DE 102006031893 a flushing water distributor has been explained. However, this system is built into the urinal or WC rim and is not suitable for use with the bidet pipe system. On the other hand the system of the present invention is suitable for use in toilet bowls without any rim/ring and furthermore it can be used with bidet pipe system.

In the document numbered EP0519885 an apparatus for cleaning the inner wall of toilet bowls has been mentioned. However, with the apparatus mentioned in this document as seen from the FIG. 1 it is not possible to wash the side rings of the toilet bowl. The inner surface of bowl is washed through the jet of water G1. A jet of water G2 is used for washing the user. Furthermore, in this system the tubular member is connected to the water line independent of the flush system.

BRIEF SUMMARY OF THE INVENTION

The present invention relates to a washing system which is to be installed on the clean water inlet channel coming from the reservoir on the sanitary ware product and which makes the toilet/closet bowl be washed and to a method for using the said system in order to wash the toilet bowl.

The installation of the system developed within the present invention is quite simple and it can easily be mounted to the product afterwards. By means of the washing system developed within the present invention, the water is provided to reach the desired parts easily.

The washing system according to the present invention comprises bidet pipe system (1), angled gasket (2) used in the bidet pipe system, a cover (3*a*) used in the washing system with bidet pipe, which is compatible with the sanitaryware product, cover (3*b*) used in the washing system without bidet pipe, which is compatible with the sanitaryware product, washing system inner body (4), washing system outer body part (7), sealing element (5), screw (6) for fixing the outer body of the system (7) to the sanitaryware product, a part (8) for fixing the outer body (7) of the system to the sanitaryware product, element (9) providing sealing between the sanitaryware product and the outer body (7), a part (10) for connecting the bidet system to the clean water pipe. The washing system according to the present invention can be used with or without bidet pipe and the system according to the present invention does not comprise the parts numbered 1, 2, 3*a* and 10 in the case that it is not used with the bidet pipe.

DESCRIPTION OF THE REFERENCES

Figure 1:
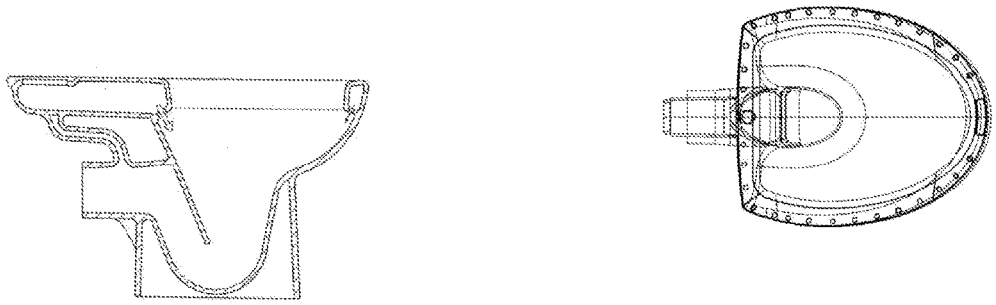
FIG. 1: The sectional view of the washing system used in the ringed toilets in the present state of the art, and the detail of the hole.

A: Washing system in the system comprising bidet pipe

B: Washing system in the system without bidet pipe

1: Bidet pipe system

2: Angled gasket used in the bidet pipe system

3*a*: Cover used in the washing system comprising bidet pipe, which is compatible with the sanitary ware product

3*b*: Cover used in the washing system without bidet pipe, which is compatible with the sanitary ware product

4: Inner body part of the washing system

4*a*: Center part of the inner body

5: Sealing element

6: Screw for fixing the outer body of the system to the sanitary ware product

7: Outer body of the washing system

8: Part for fixing the outer body of the system to the sanitary ware product

9: Sealing element providing sealing between the sanitary ware product and the outer body

10: Part for connecting the bidet system to the clean water pipe

11: Channels providing the water to flow into the toilet bowl through the side parts created on both sides, right and left, on the inner body part

12: Channel providing the water to flow downwards into the toilet bowl by granting the water with function in the middle part on the inner body part

13: Directors on the inner body

14: Coves on the side channels on the inner body parts

15: Separators for cutting the water discharge on the outer body

16: Clean water channel

16*a*: Housing into which the washing system is mounted on the sanitary ware product, water distribution channel end

17: Bidet hole on the cover, into which the bidet pipe will be mounted

18: Hole available on the body, into which the bidet pipe will be mounted

19: Reservoir

20: Holes on the fitting part through which screws pass

21: Holes on the outer body through which screws pass

DETAILED DESCRIPTION OF THE INVENTION

The present invention relates to a washing system which is to be installed on the clean water inlet channel coming from the reservoir on the sanitary ware product and which makes the toilet/closet bowl be washed and to a method for using the said system in order to wash the toilet bowl.

Figure 6A:
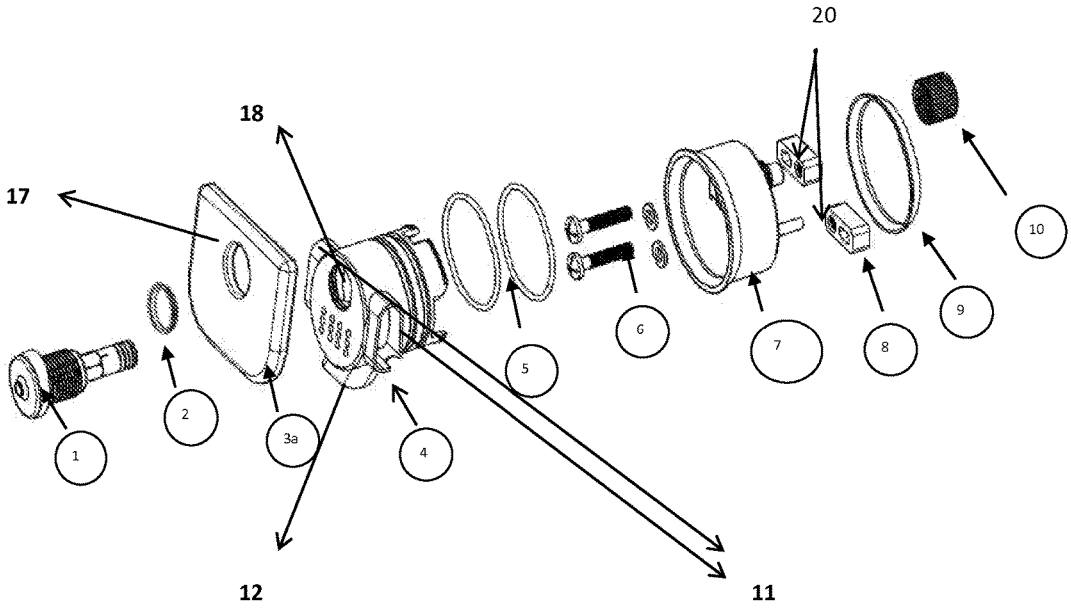
Figure 6B:
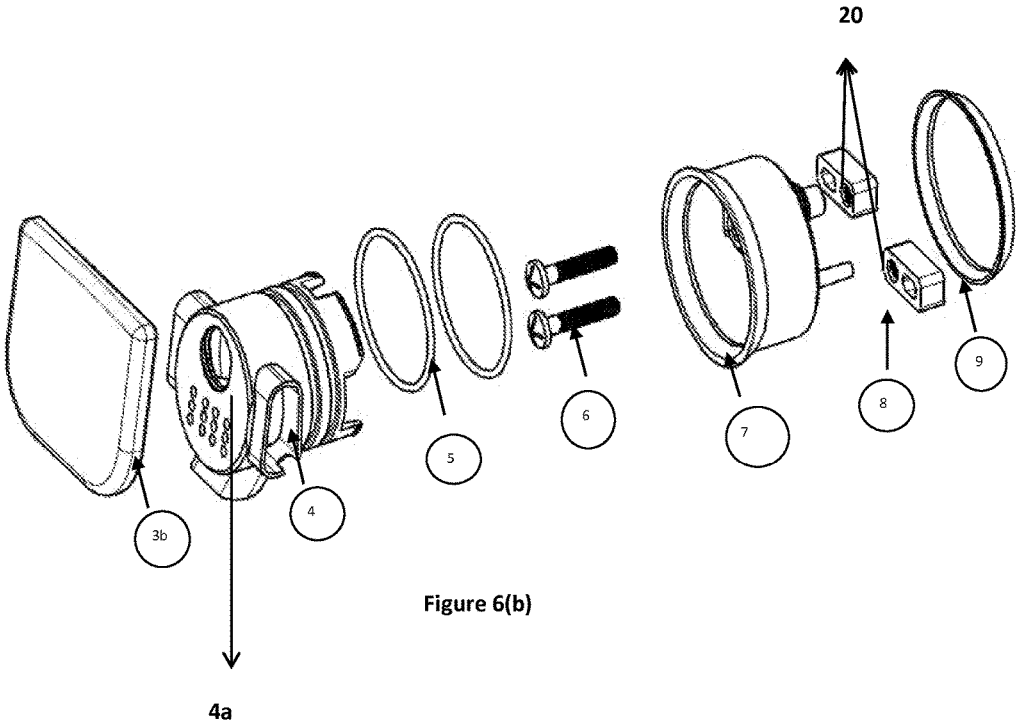
Figure 7:
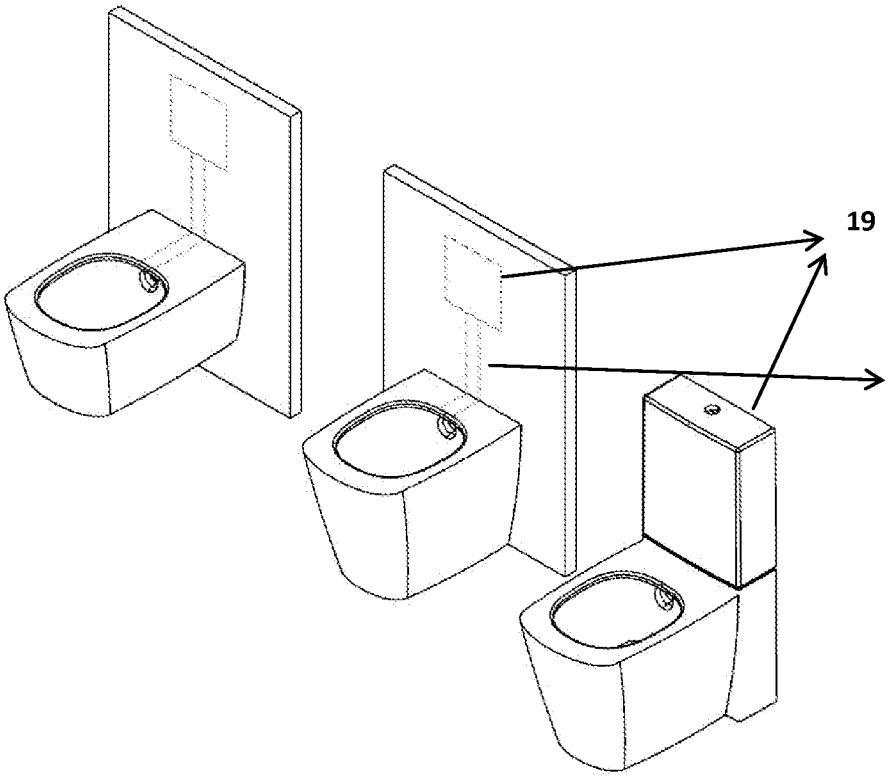
FIG. 7: The working principle of the washing system according to the present invention in different toilet types
Figure 8:
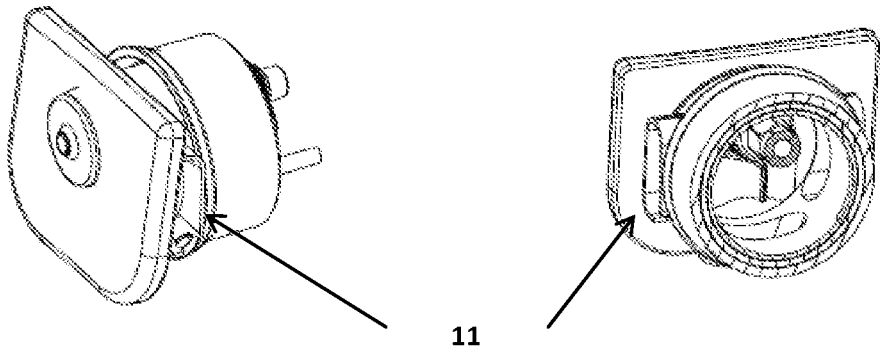
FIG. 8: The view of the side channels on the inner body in the washing system according to the present invention
Figure 9:
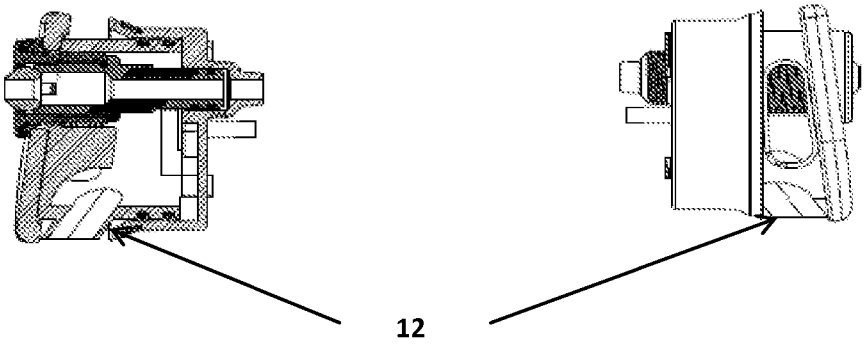
FIG. 9: The view of the channel in the middle part on the inner body in the washing system according to the present invention

The washing system according to the present invention comprises bidet pipe system (1), angled gasket (2) used in the bidet pipe system, a cover (3*a*) used in the washing system with bidet pipe, which is compatible with the sanitary ware product, cover (3*b*) used in the washing system without bidet pipe, which is compatible with the sanitary ware product, washing system inner body (4), washing system outer body part (7), sealing element (5) mounted on inner body (4), screw (6) for fixing the outer body of the system (7) to the sanitary ware product, a part (8) for fixing the outer body (7) of the system to the sanitary ware product, element (9) providing sealing between the sanitary ware product and the outer body (7), a part (10) for connecting the bidet system to the clean water pipe. In the systems which do not have bidet pipe, the parts numbered 1, 2, 3*a* and 10 are not used, and different than the washing system used in the systems comprising a bidet pipe, the cover (3*b*) is used as shown in FIG. 6*b*. This cover (3*b*) does not comprise the hole (17) on which the bidet pipe will be mounted. The working principle of the washing system is the same in both of the systems with or without the bidet pipe. The sealing elements used in the washing system and fitted onto the body (4) is preferably oring (5); while the sealing element located between the sanitaryware product and the outer body (7) is preferably gasket (9). The inner body (4) of the washing system comprises the hole (18) into which the bidet pipe will be mounted. In the case that the washing system according to the present invention is used with the bidet pipe, the hole (17) into which the bidet pipe will be mounted is available on the cover (3*a*) used in the system.

The washing system according to the present invention is mounted on the end of the clean water inlet channel (16) on the sanitaryware product, in other words into the housing (16*a*) located there. It is possible to use the washing system according to the present invention in the toilets which do not comprise ring in the inner part of the bowl. In the washing system, the water is directed by means of the distribution channel (16). In the system according to the present invention, nozzle is not used for directing the water. As in the case of the systems used in the present state of the art, the water does not come from the water installation instead the water comes from the reservoir (19) and it passes through the clean water inlet channel (16) and finally reaches to the washing system according to the present invention. It is possible to use the washing system according to the present invention together with or without the bidet pipe.

Figure 2:
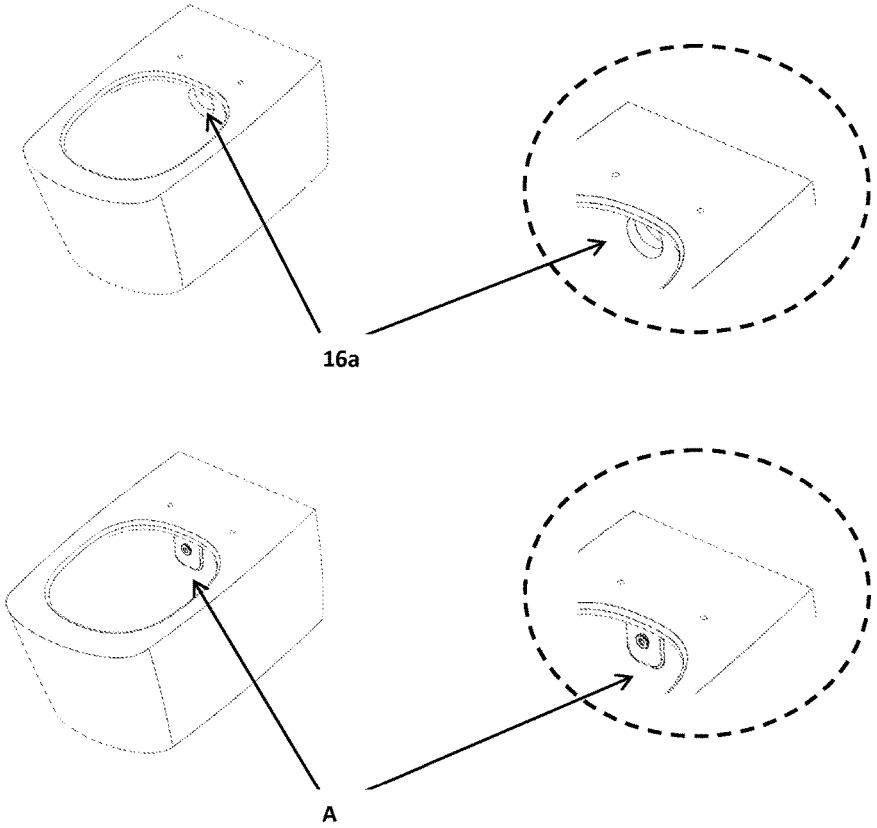
FIG. 2: Washing system housing on the sanitaryware product and the washing system according to the present invention, FIG. 3*a*): Isometric and top view of the washing system comprising bidet pipe according to the present invention, FIG. 3*b*): Isometric and top view of the washing system without bidet pipe according to the present invention, FIG. 4(*a*): The front, side and A-A sectional view of the washing system comprising bidet pipe according to the present invention FIG. 4(*b*): The front, side and A-A sectional view of the washing system without bidet pipe according to the present invention FIG. 5(*a*): The front and sectional view of the cover in the washing system comprising bidet pipe according to the present invention FIG. 5(*b*): The front and sectional view of the cover in the washing system without bidet pipe according to the present invention FIG. 6(*a*): Isometric view of the parts of the washing system comprising bidet pipe according to the present invention FIG. 6(*b*): Isometric view of the parts of the washing system without bidet pipe according to the present invention

While using the current systems according to the present state of the art, the toilet bowl is washed with the water coming from the gaps or holes created on the sanitaryware product on the other hand with the present invention the toilet bowl is washed with the washing system (A,B) installed later to the product by making some changes on the product. In order to use the system (A, B) developed within the present invention, first of all there should be a housing (16*a*) which provides the washing system to be mounted in appropriate size on the sanitary ware product (FIG. 2). This housing (16*a*) is located at the end of the clean water distribution channel (16). The outer body (7) of the washing system shown in FIGS. 6*a* and 6*b* is mounted to this housing (16*a*) with the element (9) providing sealing. The outer body (7) of the washing system is fitted on the sanitaryware product by tightening the fitting element (8) by means of screws (6). The inner body part (4) which includes o-rings (5) as the sealing element is click-fitted to the outer body (7). The orings (5) used in this part provides both tight-click and sealing. In the case that the bidet pipe is not used, finally the cover (3*b*) is fitted onto the body (4) and the installation is completed. In the case that the bidet pipe is desired to be available, the bidet pipe system (1) is fitted to the body (4) part of the washing system with the angled gasket (2) and then the cover (3*a*) is mounted, and the installation is completed. In the case that the bidet pipe is available, the part (10) connecting the bidet system to the clean water pipe is used during the installation.

Figure 3:
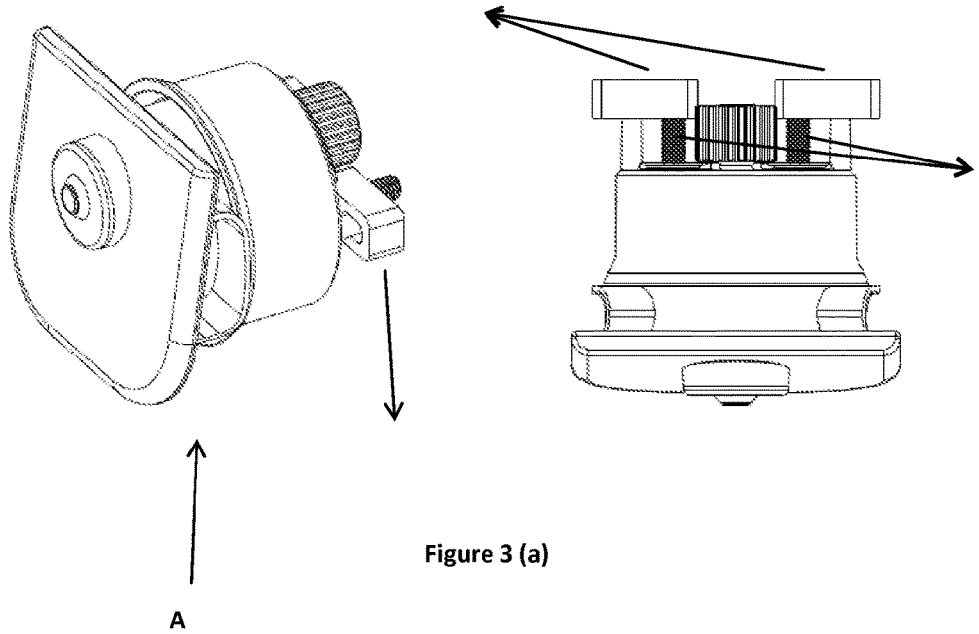
Figure 3:
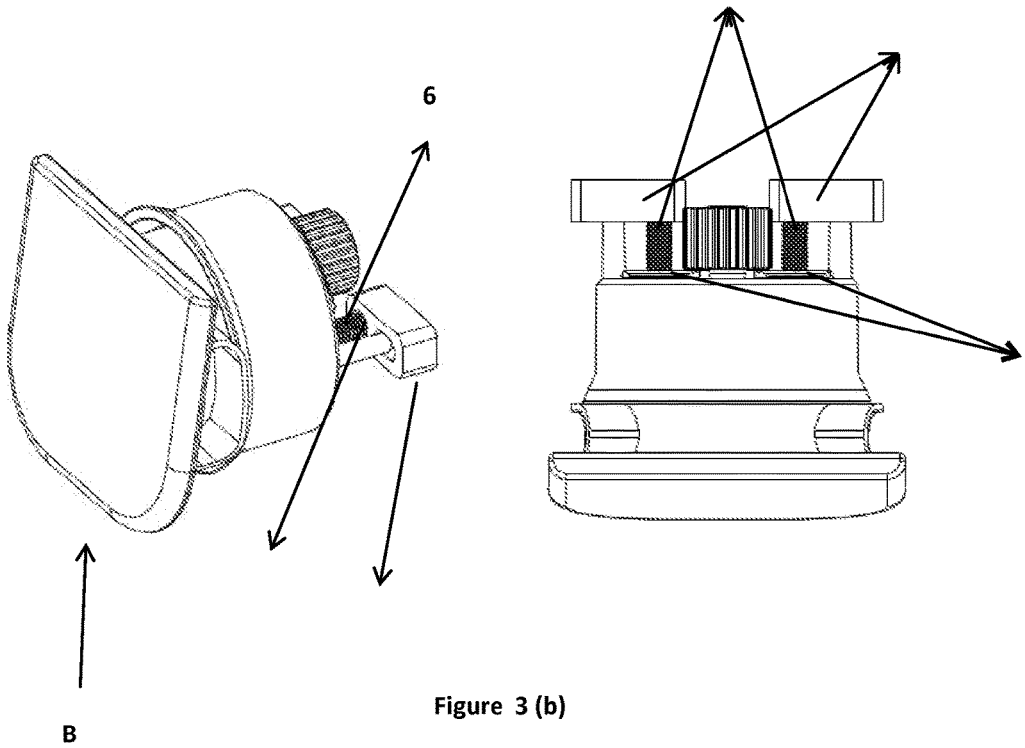
Figure 4A:
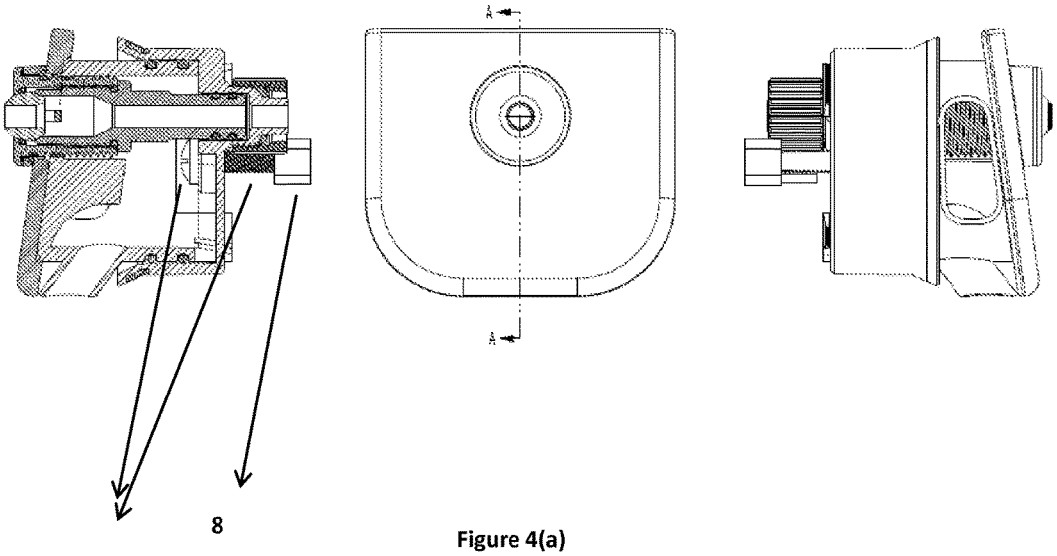
Figure 4B:
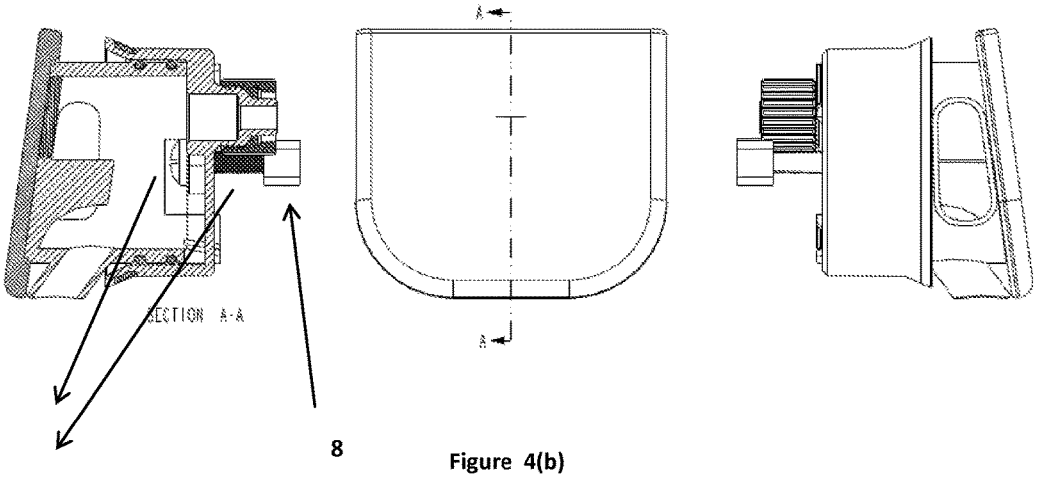
Figure 5A:
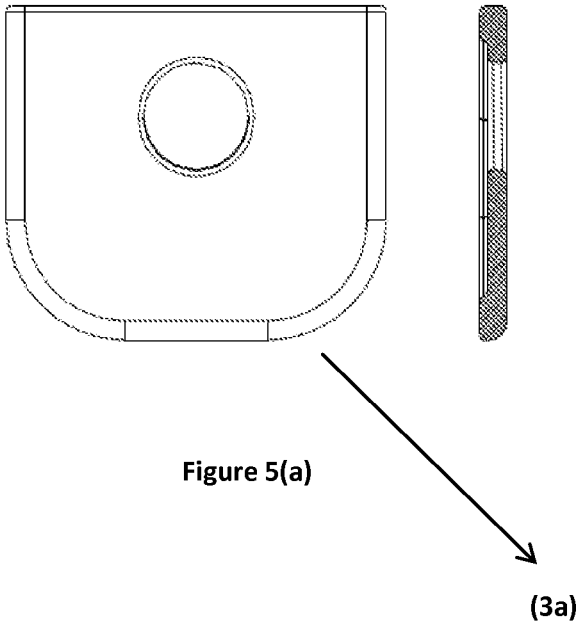
Figure 5B:
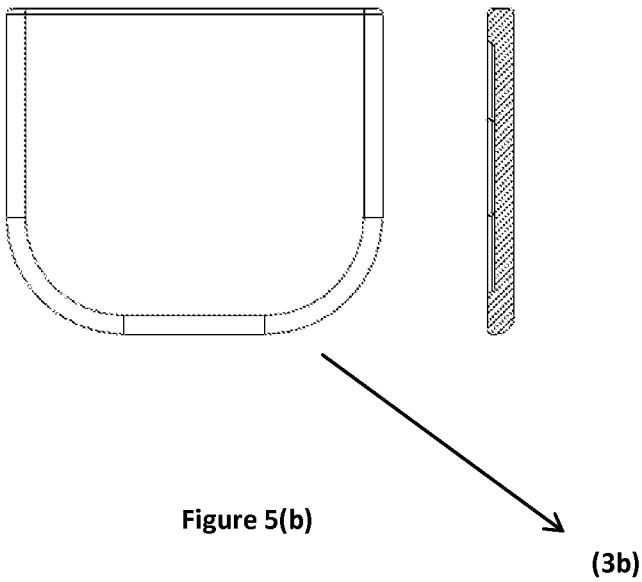
Figure 10:
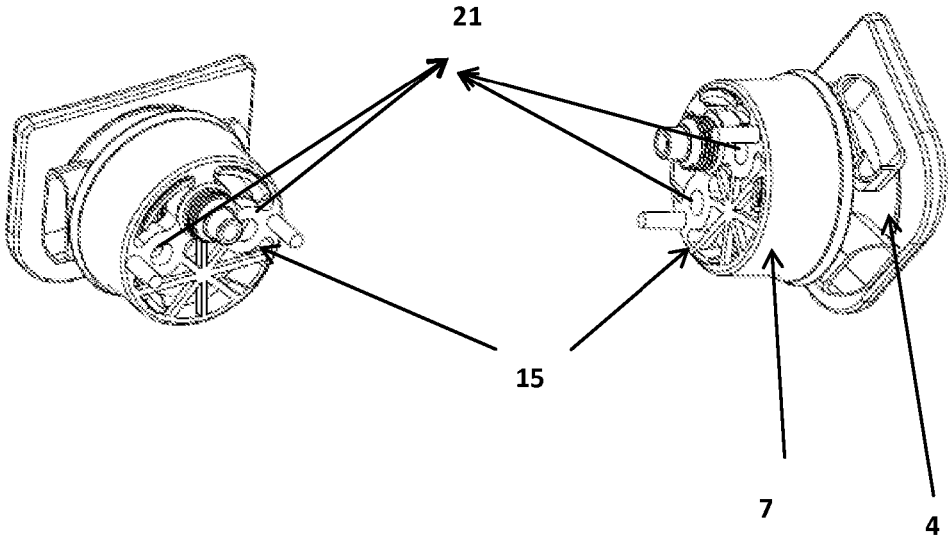
FIG. 10: The view of the separators on the outer body in the washing system according to the present invention
Figure 11:
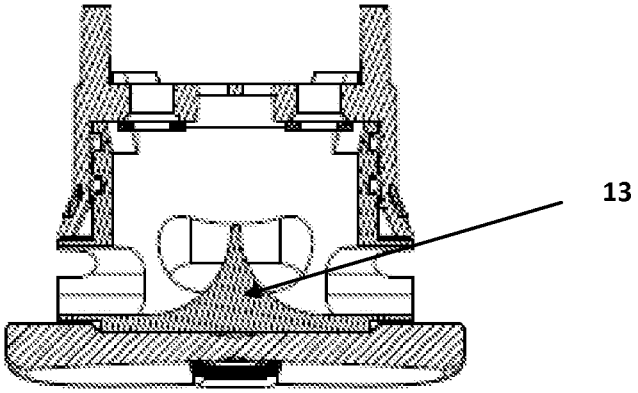
FIG. 11: The view of the directors on the inner body in the washing system according to the present invention
Figure 12:
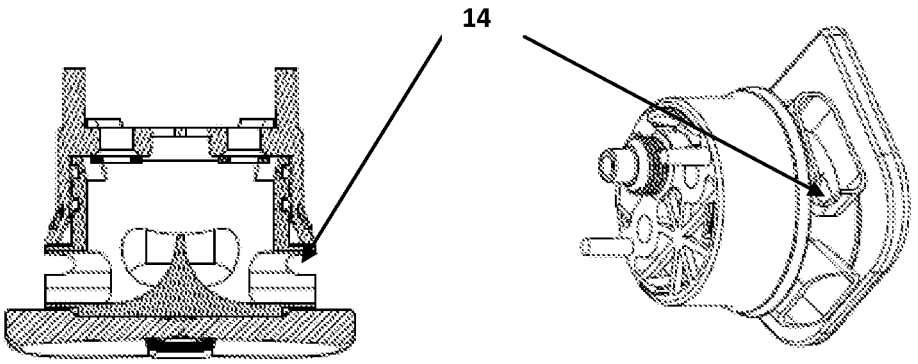
FIG. 12: The view of the coves on the side channels located on the inner body in the washing system

The cooperation of parts to provide the mounting of the system is shown on FIGS. 4*a* and 4*b*. As shown on these figures the screws (6) pass through the outer body (7) as well as through the fitting part (8). The holes positioned on fitting part (8) through which screws (6) pass shown on FIGS. 6*a* and 6*b* as well as on FIG. 3*b* with the reference numbers 20. The holes positioned on outer body through which screws (6) pass shown on FIGS. 10 and 3*b* with reference numbers 21. With the tightening of the screws (6) as mentioned above, outer body (7) is fixed on sanitary ware product since the fitting part (8) is also tightened.

As it is possible for the covers (3*a*, 3*b*) used in the washing system according to the present invention to be made of ceramic in a way that it is compatible with the sanitaryware product, it is also possible for them to be made of different materials within the present invention.

On the inner body (4) of the washing system according to the present invention, channels (11) are opened in certain diameters in a way that there will be at least one channel on the right and left sides of the inner body (4) in relation to the center of the inner body (4*a*) as shown on FIG. 6*b*. These channels (11) provide the water to progress and flow on both right and left sides laterally into the toilet bowl. Therefore, water is discharged from both sides into the bowl, and by enabling the surfaces on which the water flows to be cleaned; it becomes possible to wash a larger surface inside the bowl. In order to provide function, coves (14) are created on the side channels (11) opened on the body (4) of the washing system. On the inner body (4) part, directors (13) are located in order to direct the water to the right and left directions.

In addition to the channels (11) opened on the sides on the body (4), at least one channel (12) is opened in the middle part. The water coming from the said channel (12) directly flows into the toilet bowl in the downward direction. The channel (12) in the middle part is used to grant the flowing water with a function.

On the outer body (7), separators (15) for cutting the water-flow are composed so as to decrease the speed of the water-flow. The outer body (7) has been designed in a way that it can easily be mounted to and removed from the sanitaryware product for cleaning purposes.

As mentioned above, it is possible for the washing system according to the present invention to be used with the bidet pipe (1) or without the bidet pipe (1). The body (4) comprises a hole (18) into which the bidet pipe will be mounted. A cover (3*a*, 3*b*) is located on the outer surface of the washing system so that it becomes hygienic and aesthetic. The cover (3*a*) comprises a hole (17) into which the bidet pipe will be mounted in the case that the bidet pipe is used. The washing system with the bidet pipe is shown in FIG. 3*a* and FIG. 4*a*; while the washing system without the bidet pipe is shown in FIGS. 3*b* and 4*b*. If the washing system of the present invention will be used without a bidet then the cover (3*b*) used does not comprise the hole (17).

The working principle of the system is as follows: the water which becomes free when the reservoir button is pressed passes through the clean water channel (16) and reaches to the system; it passes through the outer body part (7) of the washing system and arrives to the inner body (4); enters into the toilet bowl through the channels (11, 12) opened in certain sizes on the body (4); and the bowl is washed. The water is directed by means of the directors (13) available on the body (4) within the washing system and flows into the bowl. The clean water coming from the reservoir flows into the toilet bowl both from the right and left part with the help of the directors (13) available in the system. At the same time, the water flows into the toilet bowl in the downward direction through the channel (12) available in the middle part on the inner body (4). The channels (11) available on the right and left sides on the body (4) direct the water to the forward direction when the water comes with a certain speed, and the water coming from both of the sides combines in the middle and creates a waterfall. With this waterfall, the function is created by means of the water flowing through the other channel (12) available in the middle part on the body. The channel (12) available in the middle part of the inner body (4) of the washing system is quite important for the washing system to create a function for the water.

The washing system according to the present invention is quite useful in that it can be installed easily, make the water function by properly distributing the water coming from the clean water channel, provide an aesthetic view, make it possible to be used in toilets without rings, the cleaning can be made easily. Moreover, the washing system can be used in toilets with or without bidet pipe. As it is not a one-piece part, it is composed of parts which can be demounted and can easily be fitted to and removed from the sanitaryware product, it can easily be cleaned. The system according to the present invention is a system which is not created on the sanitaryware product as in the case of the systems in the present state of the art and can be installed on the sanitaryware product later on and demounted from the product for cleaning purposes when desired.

The invention claimed is:

1. A washing system for mounting on a toilet, the toilet having a clean water distribution channel with a housing at an end thereof, the washing system comprising:

an inner body part comprising side channels positioned respectively on right and left sides of the inner body part in relation to a center of said inner body part, the side channels adapted to flow water coming from the clean water channel into a toilet bowl from right and left directions, said inner body part having a channel opening in the middle part and adapted to provide water flowing directly downwards into the toilet bowl;

at least one sealing element installed into the inner body part;

a cover installed on the inner body part;

an outer body part installed over the inner body part, said outer body part mounted in said housing, said inner body part installed in said outer body part, said outer body part having separators that separate the water flow so as to decrease a speed of the water flow;

a fixing part adapted to fit the outer body part to the toilet;

fixing screws adapted to fix the outer body part to the toilet by tightening the fixing part;

at least one sealing element adapted to provide impermeability between the toilet and the outer body part of the washing system;

a director mounted in the inner body part so as to direct the water to the right and left directions, said director having a plurality of directing surfaces.

2. The washing system of claim 1, further comprising:

a bidet pipe system;

an angled gasket affixed to the bidet pipe system, said cover having a hole housing said bidet pipe system; and a part connecting the bidet pipe system to a clean water pipe.

3. The washing system of claim 2, wherein the inner body has a hole into which the bidet pipe system is installed.

4. The washing system of claim 1, wherein the channels located on the right and left sides on the inner body part comprise coves, the coves directing water at an exit of the inner body part.

5. The washing system of claim 1, wherein the cover is of a ceramic material.

6. The washing system of claim 1, wherein the sealing element is an o-ring.

7. The washing system of claim 1, wherein the sealing element is a gasket.

8. A method for washing a toilet bowl with the washing system according to claim 1, the method comprising:

pressing on a reservoir button so that the clean water passes through the clean water distribution channel and reaches to the washing system;

passing water through the outer body part so as to reach the inner body part;

directing water to the channel in the middle part on the inner body part and directing water by the director to the channels positioned on the right and left sides on the inner body part;

washing the toilet bowl by directing the water in the downward direction from the middle part to the toilet bowl through the middle channel on the inner body part and to the right and left directions by the side channels.

9. A method for installing the washing system of claim 1 onto the toilet, the method comprising:

installing a bidet system to the clean water pipe;

fitting the outer body part to the housing at an end of the clean water distribution channel on the toilet so as to provide sealing by tightening the fixing part by the fixing screws;

fitting the inner body part of the washing system to the outer body part.

* * * * *